United States Patent [19]

Martin

[11] Patent Number: 4,794,702

[45] Date of Patent: Jan. 3, 1989

[54] COMBINATION BOW SIGHT

[76] Inventor: Paul D. Martin, 1216 Eighth St. SW, Mason City, Iowa 50401

[21] Appl. No.: 142,783

[22] Filed: Jan. 11, 1988

[51] Int. Cl.[4] ..... F41G 1/46

[52] U.S. Cl. ..... 33/265

[58] Field of Search ..... 33/265; 124/87

[56] References Cited

U.S. PATENT DOCUMENTS 4,120,096 10/1978 Keller ..... 33/265

4,136,462 1/1979 Topel ..... 33/265

4,462,163 7/1984 Tentler ..... 33/265

4,584,777 4/1986 Saunders ..... 33/265

*Primary Examiner*—Harry N. Haroian

[57] ABSTRACT

A bow sight pivoted to provide accuracy regardless of the elevation above the target and having sighting pins, adjustable both for elevation and for lateral deviation. The tilting plate carrying the pins can be locked into place for ease of carrying or for use in level shooting. This sight is usable on either right or left handed bows.

3 Claims, 2 Drawing Sheets

COMBINATION BOW SIGHT

BACKGROUND AND SUMMARY OF THE INVENTION

This invention pertains to archery and more particularly to a sighting device especially useful for hunting bows. The sighting device can be adjusted for lateral deviation and for sighting in on any particular bow and automatically adjusts itself for a situation where the target is substantially lower than the archer.

Hunting game with a bow and arrow has been common practice for centuries. However, the recent development of the compound bow and precise limits of tolerance in arrow making has led to far more accurate shooting in recent years. With those developments has arisen a need for a sighting mechanism of greater accuracy than was possible previously. Those sights have been developed for target shooting. They are also usable for hunting on relatively level ground.

However, when a stand is erected from which the target - whether a game animal or inanimate target - is substantially below the shooter, a fixed sight is no longer accurate. The trajectory of an arrow is somewhat dependent on the angle from the horizontal at which the target stands.

By my invention, I provide a bow sight which may be automatically adjustable for the angle of the trajectory of the arrow. It is also capable of being adjusted for the individual shooter and has multiple points adapted to be set for various ranges. Lateral adjustment is also possible. A guard is provided to allow safe carrying, and the movable part of the sight may be clamped to fix the sight while transporting it, or to hold the sight when anticipating level shooting.

FIGURES

DESCRIPTION

Figure 1:
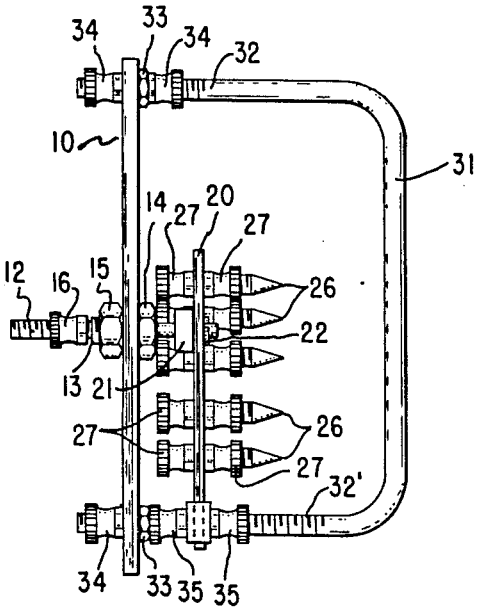
FIG. 1 is an end elevational view of the sight.
Figure 2:
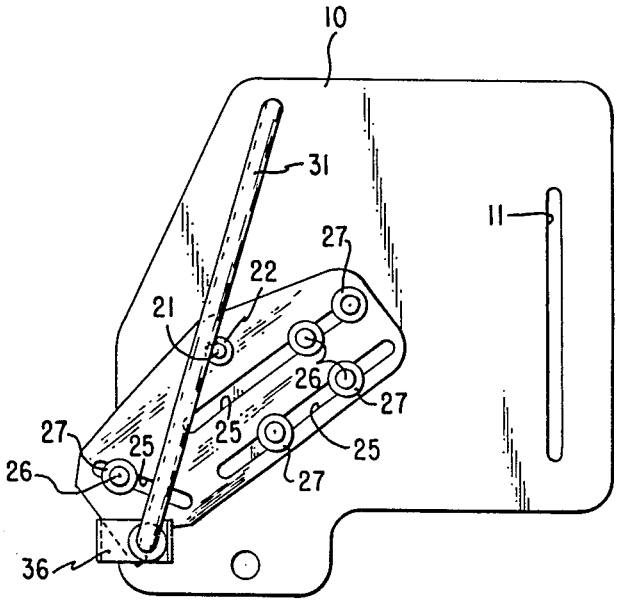
FIG. 2 is a side elevational view of the sight as in FIG. 1 with the plate in the clamped position.

Briefly, my invention comprises a bow sight completely adjustable for any individual shooter, and which will make automatic adjustments for the change of trajectory of the arrow when shooting from a tree stand or the like, well above the target. I accomplish this by using a pin plate adjustable laterally, having adjustable pins for various ranges and freely swinging for use from an elevated stand.

More specifically, and referring to the drawings, I provide a mounting plate 10 which may be fastened to a bow 9 by means of screws extending through a slot 11 formed in the plate 10. A sight axle 12 is adjustably mounted on that plate. That mounting may be of various types. My preferred method, because of the need for accuracy, is to provide a threaded bushing 13 having a bolt head 14 on one side, and being held in place on the plate by a nut 15. The bushing 13 is formed to provide a threaded central opening into which the axle 12 may be threaded. By using a relatively long axle having threads over much of its length, the position of the ends of the axle relative to the plate can be readily adjusted.

A jam nut 16 threaded on the axle in position to be pressed against the bushing 13, and adapted to be rotated by manual pressure may be used to hold the axle 12 in any adjusted position.

On the unthreaded end, the axle 12 carries a pivoting sight plate 20. The pivotal mounting of this plate must also be relatively precise so that the sighting may be accurate. Many types of mounting may be possible. However, I prefer to use a journal 21 fixed to the plate 20 and journalled on the axle 12. Sliding off the end of the axle 12 may be prevented by the use of a split washer 22. The sight plate 20 is thus free to pivot about the axle 12.

The sight plate 20 is formed to provide a plurality of slots 25. These slots are arranged so that sighting points or pins 26 may be adjustably located in the slots. The points 26 should be formed with screw threads on which nuts 27 may be threaded to hold the points in place on the plate 20. The slots 25 must be arranged so that there will be some vertical component (parallel to the slot 11) to the adjustment when the plate 20 is in its normal position.

Figure 3:
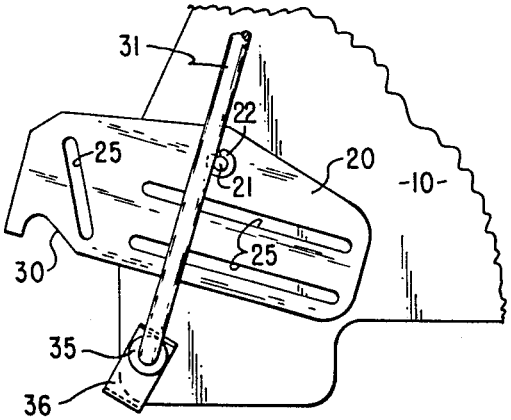
FIG. 3 is a partial view similar to FIG. 2 with the pins removed, and with the plate in a free position.
Figure 4:
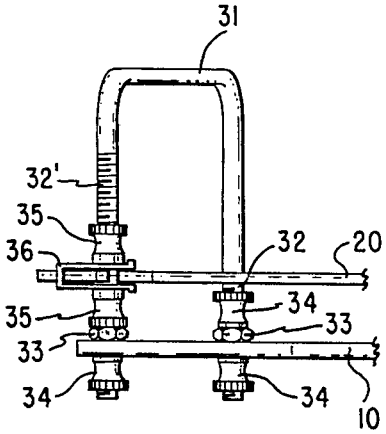
FIG. 4 is a partial top view, showing the plate clamping means.
Figure 5:
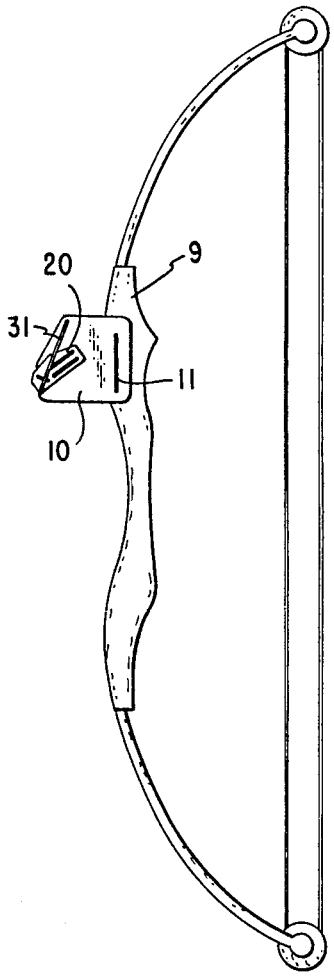
FIG. 5 is a view of the sight in place on a bow.

The plate 20 is also formed with a notch 30 (FIG. 3). This notch is placed so that when the plate 20 is pivoted to a hold position, the notch 30 embraces a guard bar 31. The bar 31 is fastened to the plate 10 in position to extend above the points 26 as best shown in FIG. 1. In this way, the points are protected to a considerable extent.

The bar 31 may be fastened to the plate by any convenient means. I prefer to provide threaded ends 31 and 32' onto which nuts 33 may be threaded on one side of the plate 10 and then thumb nuts 34 may be used to tighten against the first nuts 33 to hold the bar in place.

Clamping means for clamping the plate 20 in a single position is also provided on the end 32'. The threads on this end extend substantially up the leg. This extra thread allows a clamping device to be used. The device consists of a pair of thumb nuts 35 threaded onto the end 32' on opposite sides of a U-shaped clamp 36. The plate 20 is adapted to slide between the legs of the clamp 36, and the notch 30 is adapted to embrace the end 32'. The thumb nuts 35 can then be used to tighten the clamp 36 onto the plate. Because the position of the sight plate 20 is adjustable toward or away fromthe base plate 10, the position of the clamp 36 relative to the base plate 10 is also made adjustable.

It should be noted that all of the parts of the sight including the guard bar 31 and the axle 12 are connected to the plate only by threaded nuts which can be tightened by finger pressure. Thus, they are easily removed. Further, the pieces can be mounted on either side of the plate 10, so that the sight can be readily adapted to either a right-handed or a left-handed bow.

The use of the device will be fairly obvious from the previous description. The sight must obviously be sighted in on the chosen bow. Adjustment for lateral deviation is made by screwing the axle 12 into the bushing 13 or out of it to change the position of the sight plate 20 relative to the base plate 10. When that adjustment is satisfactory, the jam nut 16 may be tightened against the bushing 13 to hold the lateral position of the plate 20.

The sight points 26 should then be sighted in, each for its own range, whether 5 yards or 15, or 20 or other yardage as desired. Movement of the pins within the slots 25 can be used to make this adjustment. That adjustment position should be accurate when the plate 20 is held by the clamping mechanism 36. When freed, the pins will swing with the plate to adjust automatically for an angle of shooting below the stand on which the archer may be.

I claim as my invention:

1. For attachment to a bow, a bow sight comprising mounting means adapted to be attached to said bow, an axle threadably mounted relative to said mounting means, sight plate means pivotally mounted on said axle, said threadable mounting being adjustable relative to said mounting means whereby the distance between said mounting means and said sight plate can be threadably adjusted, sighting points mounted on said sight plate, guard means fastened to said mounting means and extending over said sighting points, said sight plate being engageable with said guard means and clamping means on said guard means adapted to engage said sight plate to hold said sight plate in fixed position relative to said mounting means.

2. The device of claim 1 in which said guard means includes a guard bar, said sight plate being formed with a notch to surround at least partially said guard bar, said clamping means being disposed on said guard bar in position to engage said sight plate at a location adjacent said notch.

3. The device of claim 1 in which said clamping means is adjustable toward and away from said mounting means to match the adjusted location of said sight plate.

* * * * *